US012768282B2

(12) United States Patent
Marini et al.

(10) Patent No.: US 12,768,282 B2
(45) Date of Patent: Oct. 20, 2026

(54) SHROUDED TURBINE ASSEMBLY FOR GAS TURBINE ENGINE

(71) Applicant: Pratt & Whitney Canada Corp., Longueuil (CA)

(72) Inventors: Remo Marini, Lasalle (CA); Sami Girgis, L'orignal (CA); Amin Afroosheh, Candiac (CA); Guy Lefebvre, St-Bruno (CA); Remy Synnott, St-Jean-sur-Richelieu (CA)

(73) Assignee: Pratt & Whitney Canada Corp., Longueuil (CA)

( * ) Notice: Subject to any disclaimer, the term of this patent is extended or adjusted under 35 U.S.C. 154(b) by 0 days.

(21) Appl. No.: 18/743,803

(22) Filed: Jun. 14, 2024

(65) Prior Publication Data

US 2025/0382893 A1 Dec. 18, 2025

(51) Int. Cl.

| | |
|---|---|
| ***F01D 11/08*** | (2006.01) |
| ***F01D 5/22*** | (2006.01) |
| ***F01D 11/00*** | (2006.01) |
| ***F01D 11/02*** | (2006.01) |
| ***F01D 25/24*** | (2006.01) |

(52) U.S. Cl.

CPC ..... *F01D 11/08* (2013.01); *F01D 5/225* (2013.01); *F01D 11/001* (2013.01); *F01D 11/02* (2013.01); *F01D 25/24* (2013.01)

(58) Field of Classification Search

CPC ..... F01D 5/225; F01D 11/001; F01D 11/02; F01D 11/08

See application file for complete search history.

(56) References Cited

U.S. PATENT DOCUMENTS 4,662,820 A * 5/1987 Sasada ..... F04D 29/161 415/173.6

5,290,144 A 3/1994 Kreitmeier (Continued)

FOREIGN PATENT DOCUMENTS

EP 3822461 A1 * 5/2021 ..... F01D 5/225

JP H10266808 A 10/1998

(Continued)

OTHER PUBLICATIONS

EP Search Report for EP Patent Application No. 25183062.6 dated Aug. 1, 2025.

*Primary Examiner* — Brian P Wolcott

(74) *Attorney, Agent, or Firm* — Getz Balich LLC

(57) ABSTRACT

A shrouded turbine assembly for a gas turbine engine is provided that includes a rotor assembly and a forward vane assembly. The rotor assembly has a plurality of rotor blades circumferentially distributed around a disk. Each rotor blade extends from the disk to a shrouded end, and each rotor blade has a shroud disposed at the shrouded end. The forward vane assembly is disposed forward of the rotor assembly. The forward vane assembly has a plurality of first vanes disposed in an annular configuration, with each first vane extending between a first vane inner radial platform to a first vane outer radial platform. The forward vane assembly includes an outer radial casing that includes a casing segment and an air diverter. The air diverter extends axially and is disposed radially outside of the shroud of each rotor blade of the plurality of rotor blades.

14 Claims, 7 Drawing Sheets

(56) References Cited

U.S. PATENT DOCUMENTS

| | | | | |
|---|---|---|---|---|
| 8,333,557 | B2 * | 12/2012 | John | F01D 11/001 415/173.1 |
| 9,151,174 | B2 | 10/2015 | Chouhan | |
| 9,291,061 | B2 * | 3/2016 | Chouhan | F01D 11/08 |
| 10,641,107 | B2 | 5/2020 | Coull | |
| 10,934,858 | B2 | 3/2021 | Schroeder | |
| 11,339,676 | B2 * | 5/2022 | Fujimura | F16J 15/447 |
| 2004/0223844 | A1 | 11/2004 | Farrell | |
| 2011/0070072 | A1 | 3/2011 | Subramaniyan | |
| 2012/0134780 | A1 | 5/2012 | Khanin | |
| 2013/0272888 | A1 | 10/2013 | Chouhan | |
| 2015/0132114 | A1 | 5/2015 | Fukushima | |
| 2024/0011407 | A1 | 1/2024 | Andreoli | |
| 2025/0382885 | A1 | 12/2025 | Von Brauneck | |
| 2025/0382893 | A1 | 12/2025 | Marini | |

FOREIGN PATENT DOCUMENTS

| | | | | |
|---|---|---|---|---|
| JP | 2001193405 | A | 7/2001 | |
| JP | 2009047043 | A | 3/2009 | |
| WO | WO-2014115706 | A1 * | 7/2014 | F16J 15/447 |

* cited by examiner

SHROUDED TURBINE ASSEMBLY FOR GAS TURBINE ENGINE

BACKGROUND OF THE INVENTION

1. Technical Field

The present disclosure relates gas turbine engines in general and to gas turbine engines having a shrouded rotor assembly in particular.

2. Background Information

Shrouded finned rotor blades may be used to form a gas path over the leading and trailing edges (LE/TE) of the airfoil portion of the rotor blade. In some applications, a shrouded finned rotor blade can provide desirable aerodynamic performance in the blade tip region despite the fact that some of the core gas flow passes over the blade fins, does no work, and creates re-entry flow mixing losses. While full shrouded blades may be desirable for aerodynamic performance, they may create stress concerns for the airfoil portion of the rotor blade. The stress concerns may be alleviated with the use of partially shrouded blades that have less blade shroud mass. The reduced shroud coverage, however, can compromise the turbine efficiency due to decreased gas path air guidance, flow disturbances in the cavity above the partial shroud leading edge prior to reaching the first fin (lost gas path flow momentum, i.e., parasitic work), the potential for an increased amount of air bypassing the rotor blade airfoil (less work is extracted), and potentially increased tip leakage re-entry flow mixing losses. Therefore, partially shrouded finned blade coverage is known to be less than optimal and leads to a turbine efficiency penalty; e.g., an increase engine cycle specific fuel consumption (SFC). It would be desirable to have a shrouded turbine blade arrangement that is an improvement over existing designs.

SUMMARY

According to an aspect of the present disclosure, a shrouded turbine assembly for a gas turbine engine is provided that includes a rotor assembly and a forward vane assembly. The rotor assembly has a plurality of rotor blades circumferentially distributed around a disk. Each rotor blade extends from the disk to a shrouded end, and each rotor blade has a shroud disposed at the shrouded end. The forward vane assembly is disposed forward of the rotor assembly. The forward vane assembly has a plurality of first vanes disposed in an annular configuration, with each first vane extending between a first vane inner radial platform to a first vane outer radial platform. The forward vane assembly includes an outer radial casing that includes a casing segment and an air diverter. The air diverter extends axially and is disposed radially outside of the shroud of each rotor blade of the plurality of rotor blades.

In any of the aspects or embodiments described above and herein, the shroud of each rotor blade of the plurality of rotor blades may include a leading edge portion, a trailing edge portion, and at least one shroud fin.

In any of the aspects or embodiments described above and herein, the air diverter may be disposed radially outside of the leading edge portion of the shroud of each rotor blade of the plurality of rotor blades.

In any of the aspects or embodiments described above and herein, the air diverter may have an inner radial surface, an outer radial surface, and a tip surface that extends between the inner radial surface and the outer radial surface.

In any of the aspects or embodiments described above and herein, the outer radial surface and the tip surface may intersect with one another at an intersection and may be configured to form an acute angle between the outer radial surface and the tip surface at the intersection.

In any of the aspects or embodiments described above and herein, the inner radial surface may be radially spaced apart from the leading edge portion of the shroud of each rotor blade of the plurality of rotor blades by a radial gap.

In any of the aspects or embodiments described above and herein, the inner radial surface may be parallel the leading edge portion of the shroud of each rotor blade of the plurality of rotor blades.

In any of the aspects or embodiments described above and herein, the inner radial surface may be non-parallel the leading edge portion of the shroud of each rotor blade of the plurality of rotor blades.

In any of the aspects or embodiments described above and herein, the tip surface may be axially spaced apart from the shroud fin of each rotor blade of the plurality of rotor blades by an axial gap.

In any of the aspects or embodiments described above and herein, the rotor assembly may be configured to rotate about a central axis, and the air diverter and the leading edge portion of the shroud of each rotor blade of the plurality of rotor blades may be both disposed at an acute angle relative to the central axis of the rotor assembly.

In any of the aspects or embodiments described above and herein, the air diverter may include a tip extension that extends outwardly from the outer radial surface of the air diverter and is disposed adjacent the tip surface.

In any of the aspects or embodiments described above and herein, the shrouded turbine assembly may include an aft vane assembly disposed aft of the rotor assembly. The aft vane assembly has a plurality of second vanes disposed in an annular configuration. Each second vane of the plurality of second vanes may extend from a second vane inner radial platform to a second vane outer radial platform. The aft vane assembly may include an second outer radial casing that extends forward of the plurality of second vanes and is disposed radially outside of the shroud of each rotor blade of the plurality of rotor blades. The second outer radial casing may be engaged with the outer radial casing of the forward vane assembly to form an annular cavity disposed radially outside of the rotor assembly.

In any of the aspects or embodiments described above and herein, the shrouded turbine assembly may include an outer rotor blade seal disposed in the annular cavity.

In any of the aspects or embodiments described above and herein, the shroud of each rotor blade may be a partial shroud or a full shroud.

In any of the aspects or embodiments described above and herein, the air diverter has an inner radial surface, an outer radial surface, a base end, a tip surface that extends between the inner radial surface and the outer radial surface, and a thickness between the inner radial surface and the outer radial surface, wherein the thickness may be uniform for substantially all of the distance between the base end and the tip surface.

In any of the aspects or embodiments described above and herein, the air diverter has an inner radial surface, an outer radial surface, a base end, a tip surface that extends between the inner radial surface and the outer radial surface, and a thickness between the inner radial surface and the outer radial surface, wherein the thickness may be non-uniform between the base end and the tip surface.

According to an aspect of the present disclosure, a shrouded turbine assembly for a gas turbine engine is provided that includes a rotor assembly, a forward vane assembly, and a seal ring. The rotor assembly has a plurality of rotor blades circumferentially distributed around a disk. Each rotor blade extends from the disk to a shrouded end, and each rotor blade has a shroud disposed at the shrouded end. The forward vane assembly is disposed forward of the rotor assembly. The forward vane assembly has a plurality of vanes disposed in an annular configuration, with each vane of the plurality of vanes extending from an inner radial platform to an outer radial platform. The forward vane assembly includes an outer radial casing that includes a casing segment and a support flange extending outwardly from the casing segment. The seal ring is engaged with the casing segment and the support flange, and the seal ring is disposed radially outside of the shroud of each rotor blade of the plurality of rotor blades.

In any of the aspects or embodiments described above and herein, the shroud of each rotor blade may include a leading edge portion, a trailing edge portion, and at least one shroud fin, and the seal ring may be disposed radially outside of the leading edge portion of the shroud of each rotor blade of the plurality of rotor blades, and the seal ring may have an inner radial surface, an outer radial surface, and an aft surface that extends between the inner radial surface and the outer radial surface, and the inner radial surface may be radially spaced apart from the leading edge portion of the shroud of each rotor blade of the plurality of rotor blades by a radial gap, and the aft surface may be axially spaced apart from the shroud fin of each rotor blade of the plurality of rotor blades by an axial gap, and the seal ring may comprise an abradable material configured as a honeycomb lattice.

According to an aspect of the present disclosure, a gas turbine engine is provided that includes a rotor assembly, a forward vane assembly, and an aft vane assembly. The rotor assembly has a plurality of rotor blades circumferentially distributed around a disk. Each rotor blade of the plurality of rotor blades extends from the disk to a shrouded end, and each rotor blade has a shroud disposed at the shrouded end. The forward vane assembly is disposed forward of the rotor assembly. The forward vane assembly has a plurality of first vanes disposed in an annular configuration, with each first vane of the plurality of first vanes extending between a first vane inner radial platform to a first vane outer radial platform. The forward vane assembly includes an outer radial casing that includes a casing segment and an air diverter. The air diverter extends axially and is disposed radially outside of the shroud of each rotor blade of the plurality of rotor blades. The aft vane assembly is disposed aft of the rotor assembly. The aft vane assembly has a plurality of second vanes disposed in an annular configuration, with each second vane of the plurality of second vanes extending from a second vane inner radial platform to a second vane outer radial platform\. The aft vane assembly includes an second outer radial casing that extends forward of the plurality of second vanes and is disposed radially outside of the shroud of each rotor blade of the plurality of rotor blades, and is engaged with the outer radial casing of the forward vane assembly to form an annular cavity disposed radially outside of the rotor assembly.

The foregoing features and elements may be combined in various combinations without exclusivity, unless expressly indicated otherwise. For example, aspects and/or embodiments of the present disclosure may include any one or more of the individual features or elements disclosed above and/or below alone or in any combination thereof. These features and elements as well as the operation thereof will become more apparent in light of the following description and the accompanying drawings. It should be understood, however, the following description and drawings are intended to be exemplary in nature and non-limiting.

DETAILED DESCRIPTION

Aspects of the present disclosure are directed to a shrouded turbine assembly that includes a rotor assembly and a forward vane assembly outer radial casing. Some embodiments of the present disclosure may also include an aft vane assembly outer radial casing (or other casing structure) that is engaged with the forward vane assembly outer radial casing to create a casing structure radially outside of the rotor assembly. Some embodiments of the present disclosure may also include an outer rotor blade seal disposed between the casing structure and the rotor blade shroud as will be detailed herein.

Figure 1:
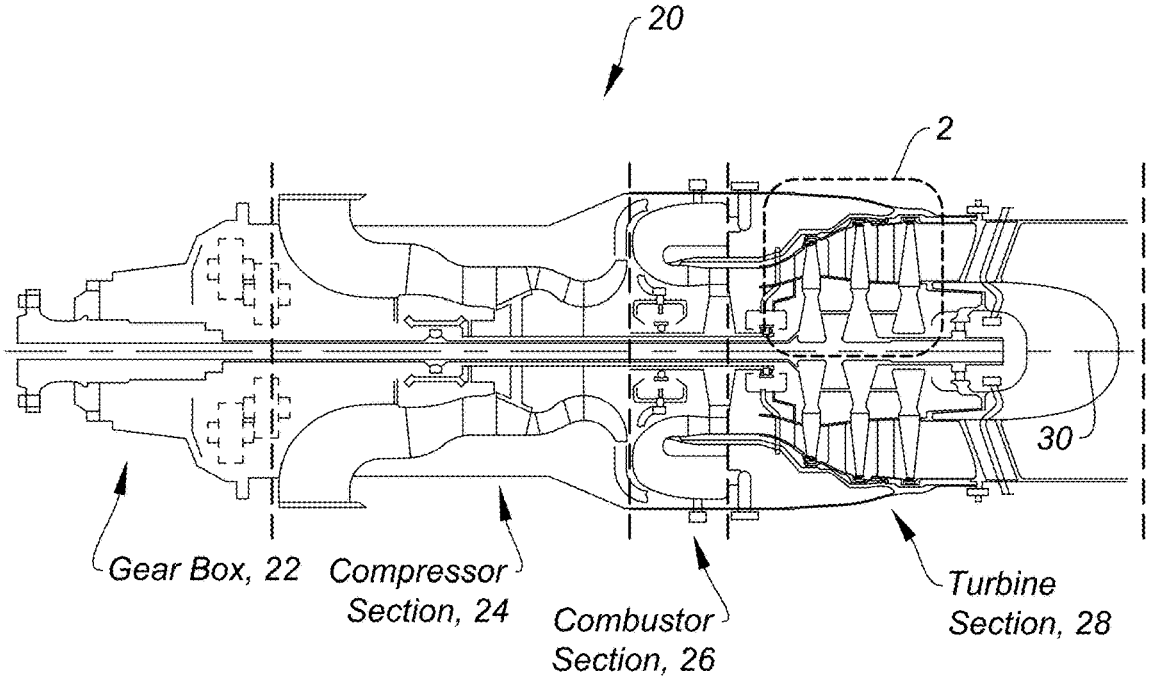
FIG. 1 is a diagrammatic sectional view of a gas turbine engine embodiment.

FIG. 1 diagrammatically shows a partially sectioned diagrammatic view of a gas turbine engine 20. The gas turbine engine 20 includes a gear box 22, compressor section 24, a combustor section 26, a turbine section 28, and an axial centerline 30. The engine sections 20-28 are arranged sequentially along the centerline 30. The terms "forward", "leading", "aft, "trailing" are used herein to indicate the relative position of a component or surface. As air passes through the engine 20, a "leading edge" of a stator vane or rotor blade encounters the air before the "trailing edge" of the same. The compressor section 24 is "forward" of the combustor section 26 and the turbine section 28 is "aft" of the combustor section 26. The terms "inner radial" and "outer radial" refer to relative radial positions from the engine centerline 30. An inner radial component or path is disposed radially closer to the engine centerline 30 than an outer radial component or path. The gas turbine engine 20 diagrammatically shown in FIG. 1 is an example provided to facilitate the description herein. The present disclosure is not limited to any particular gas turbine engine configuration.

Figure 2:
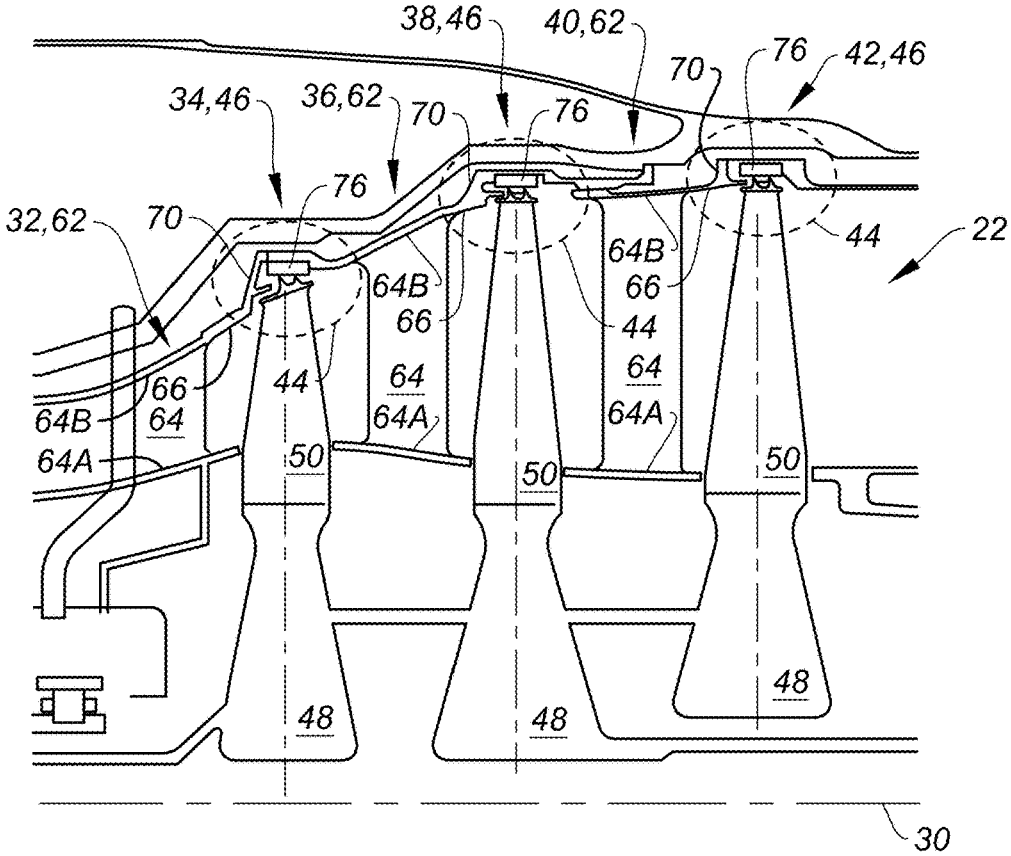
FIG. 2 is an enlarged view of the sectional view of FIG. 1.

FIG. 2 is an enlarged portion of the turbine section 28 of the gas turbine engine 20 shown in FIG. 1. The enlarged view of FIG. 2 diagrammatically shows a second turbine vane assembly 32, a second turbine rotor assembly 34, a third turbine vane assembly 36, a third turbine rotor assembly 38, a fourth turbine vane assembly 40, and a fourth turbine rotor assembly 42. Embodiments of the present disclosure shrouded turbine assembly 44 are shown in the second, third, and fourth turbine rotor assemblies 34, 38, 42. FIG. 2 is provided to illustrate examples of the present disclosure and is not intended to be limiting. For example, in some gas turbine applications an embodiment of the present disclosure may be utilized with a single turbine rotor assembly within a turbine section 28, or as shown in FIG. 2 embodiments of the present disclosure may be utilized with more than one turbine rotor assembly within a turbine section 28.

Figure 3:
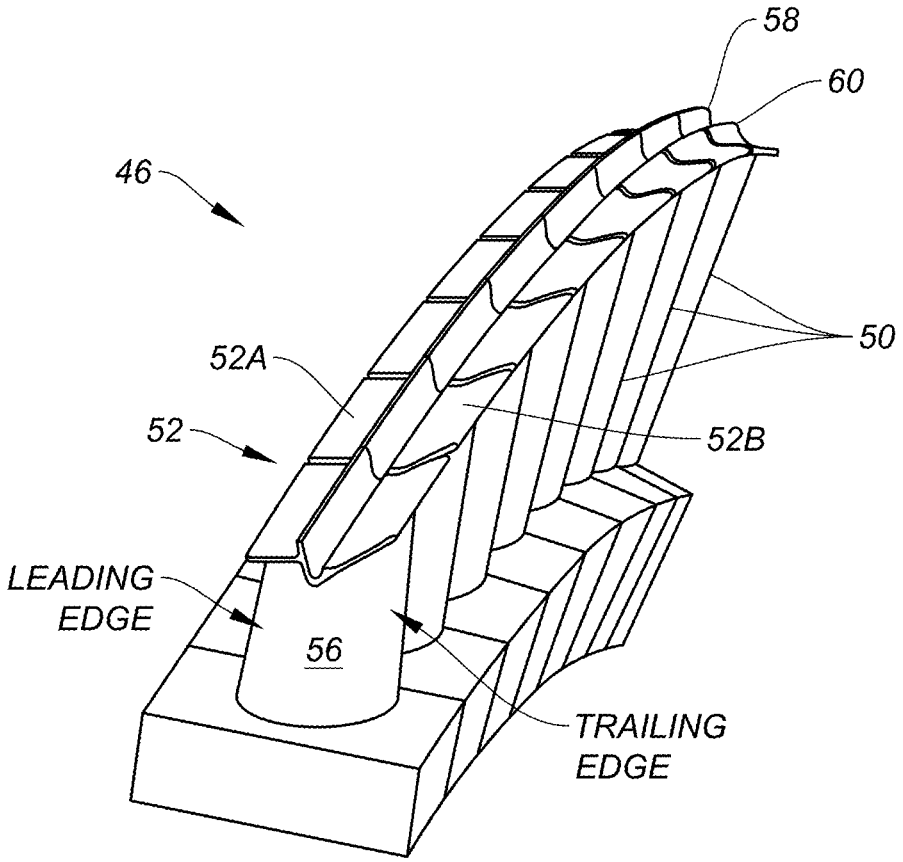
FIG. 3 is a diagrammatic partial view of a rotor assembly having fully shrouded rotor blades.
Figure 3A:
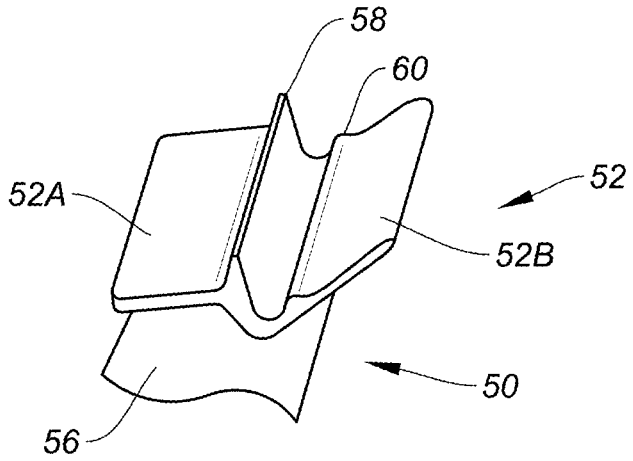
FIG. 3A is an enlarged partial view of a fully shrouded rotor blade as shown in FIG. 3.
Figure 4:
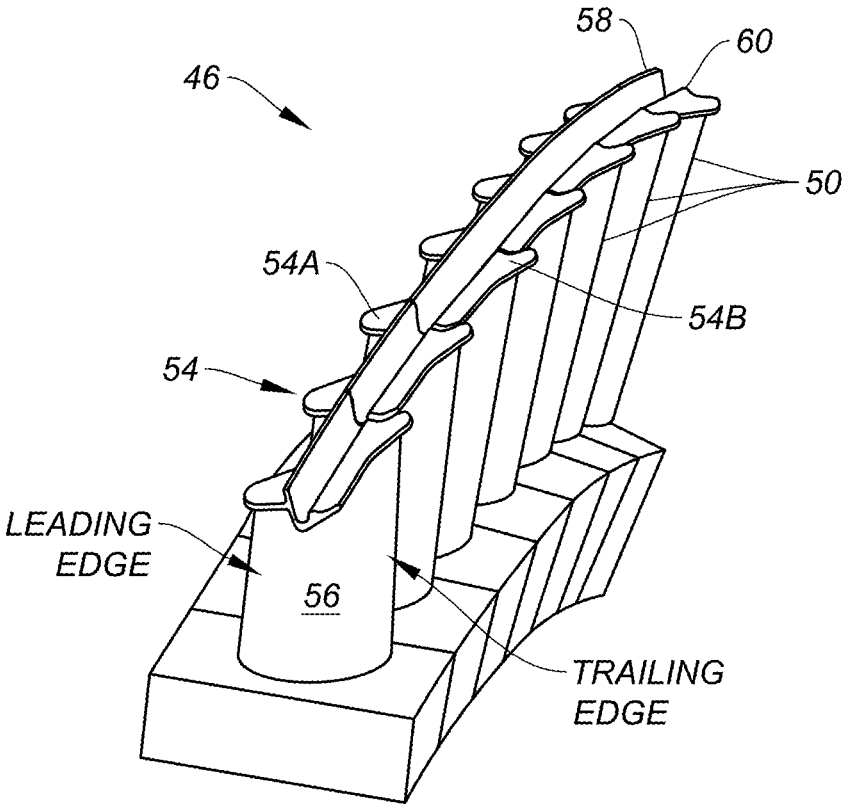
FIG. 4 is a diagrammatic partial view of a rotor assembly having partially shrouded rotor blades.
Figure 4A:
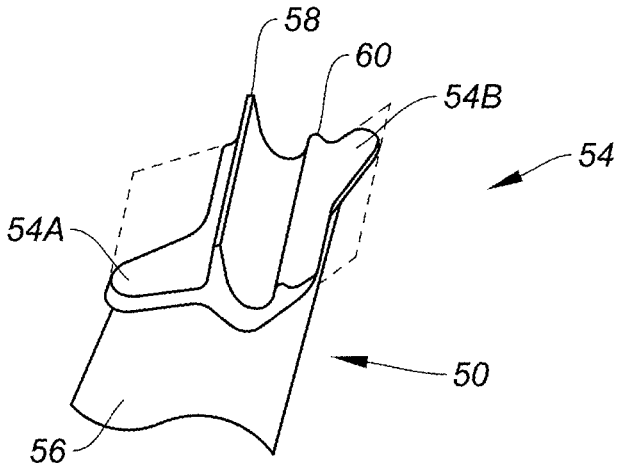
FIG. 4A is an enlarged partial view of a fully shrouded rotor blade as shown in FIG. 4.

Still referring to FIG. 2, the rotor assembly 46 of the present disclosure shrouded turbine assembly 44 includes a disk 48 and a plurality of turbine rotor blades 50 that are distributed around the circumference of the disk 48. The rotor assembly 46 is configured to rotate about a central axis that maybe coincident with the central axis 30 of the gas turbine engine 20. Each rotor blade 50 is attached to the disk 48 and extends radially outward from the disk 48. The rotor assembly 46 may be configured to include rotor blades 50 with full shrouds 52 or may be configured to include rotor blades 50 with partial shrouds 54. FIG. 3 is a diagrammatic partial view of a rotor assembly 46 having fully shrouded rotor blades 50. FIG. 3A is an enlarged partial view of a fully shrouded rotor blade 50 as shown in FIG. 3. Each fully shrouded rotor blade 50 includes a leading edge shroud portion 52A and a trailing edge shroud portion 52B disposed at the outer radial end of the airfoil 56 of the rotor blade 50. A full shroud 52, as that term is used herein, refers to a shroud having leading edge and trailing edge portions that extend between adjacent shrouded rotor blades 50. FIG. 4 is a diagrammatic partial view of a rotor assembly 46 having partially shrouded rotor blades 50. Each partially shrouded rotor blade 50 may include a leading edge shroud portion 54A and a trailing edge shroud portion 54B disposed at the outer radial end of the airfoil 56 of the rotor blade 50. The dashed lines in FIG. 4A diagrammatically illustrate the differences between a partially shrouded blade (shown in solid lines) and a fully shrouded blade (full shroud portions missing in a partial shroud are represented by dashed lines). The shroud geometries shown in FIGS. 3-4A are provided to illustrate fully shrouded rotor blades 50 and partially shrouded blades 50 and the present disclosure is not limited to any particular full shroud 52 geometry or partial shroud 54 geometry. The shroud geometries shown in FIGS. 3-4A include a first shroud fin 58 and a second shroud fin 60 extending radially outwardly, relative to the rotor blade airfoil 56. The shroud fin geometries shown in FIGS. 3-4A are provided to illustrate shroud fin geometries and the present disclosure is not limited to these shroud fin geometries.

The forward vane assembly 62 (e.g., see FIG. 2) is an annular structure that includes a plurality of vanes 64 that are circumferentially distributed. Each vane 64 extends radially between an inner radial platform 64A and an outer radial platform 64B. As described herein and shown in FIG. 2, a rotor assembly 46 may be disposed between a forward vane assembly and an aft vane assembly, and the outer radial casing structure for the forward vane assembly may cooperate with the outer radial casing structure for the aft vane assembly to create a casing structure radially outside of the shrouded turbine rotor assembly 46. To be clear, a vane assembly 62 may be both a forward vane assembly and an aft vane assembly; e.g., in FIG. 2, the third vane assembly 36 is an aft vane assembly relative to the second turbine rotor assembly 34 and a forward vane assembly relative to the third turbine rotor assembly 38.

FIGS. 5-8 diagrammatically illustrate present disclosure shrouded turbine assembly 44 embodiments. In these embodiments, the rotor assembly 46 includes a plurality of turbine rotor blades 50 each having a partial shroud 54. The partial shroud 54 includes a forward shroud portion 54A, an aft shroud portion 54B, and a pair of shroud fins 58, 60; e.g., a first shroud fin 58 and a second shroud fin 60. The present disclosure is not limited to the shroud 54 having any particular number of shroud fins or any particular shroud fin configuration.

The shrouded turbine assembly 44 embodiments diagrammatically illustrated in FIGS. 5-8 include an outer radial casing structure 66 of the forward vane assembly. These embodiments are also shown with a portion of an outer radial casing structure 68 for the aft vane assembly. As indicated herein, the outer radial casing structure 66 for the forward vane assembly and the outer radial casing structure 68 for the aft vane assembly may cooperate with one another to collectively create a casing structure cavity radially outside of the rotor assembly 46 but the present disclosure is not limited to this specific casing structure example. To facilitate the description herein, however, the casing structure radially outside of the rotor assembly 46 will be described as being collectively formed by the outer radial casing structures 66, 68 of the forward and aft vane assemblies.

The outer radial casing structure 66 for the forward vane assembly includes a casing segment 70 and an air diverter 72 extending outwardly from the casing segment 70. The air diverter 72 may be integrally formed with the casing segment 70 (e.g., see FIGS. 5-7) or it may be an independent structure that is attached to the casing segment 70; e.g., by weldment, mechanical fastener, or the like.

The casing segment 70 is configured to cooperate with the outer radial casing structure 68 of the aft vane assembly to form an annular cavity 74 disposed radially outside of the rotor blades 50 of the rotor assembly 46. The air diverter 72 extends around the circumference of the shrouded turbine assembly 44. The air diverter 72 may extend continuously around the circumference of the shrouded turbine assembly 44 or it may be collectively formed by circumferential segments. An outer rotor blade seal 76 is disposed in an outer radial region of the annular cavity 74, radially outside of the rotor assembly 46. In this position, the shroud fins 58, 60 are aligned with the outer rotor blade seal 76.

Figure 5:
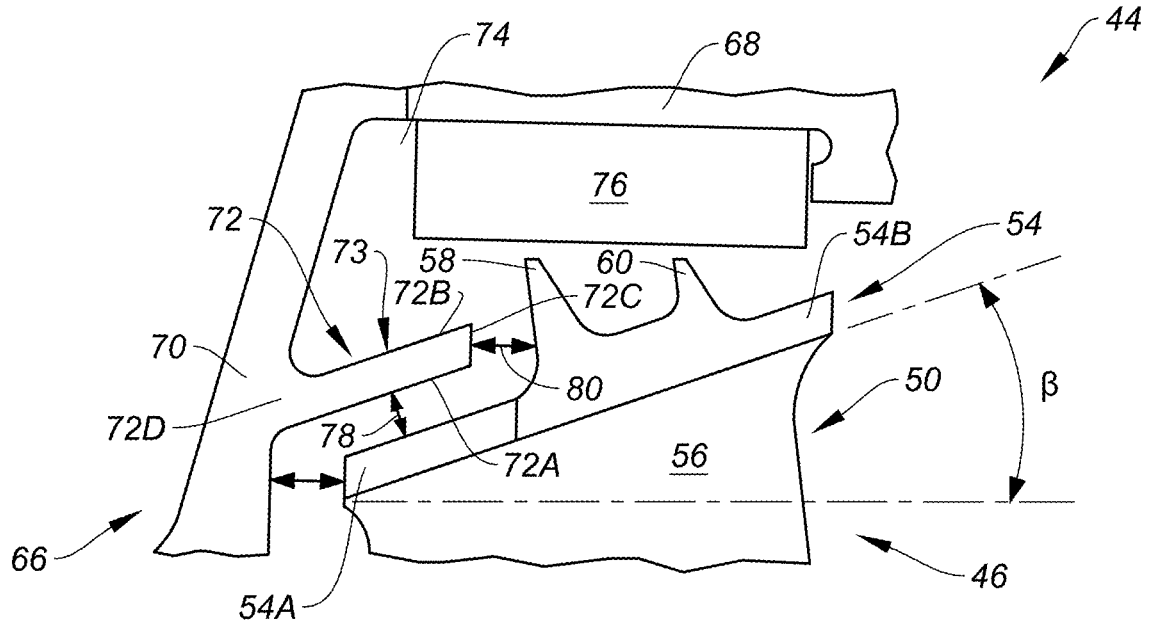
FIG. 5 is a diagrammatic view of a present disclosure shrouded turbine assembly embodiment.
Figure 5A:
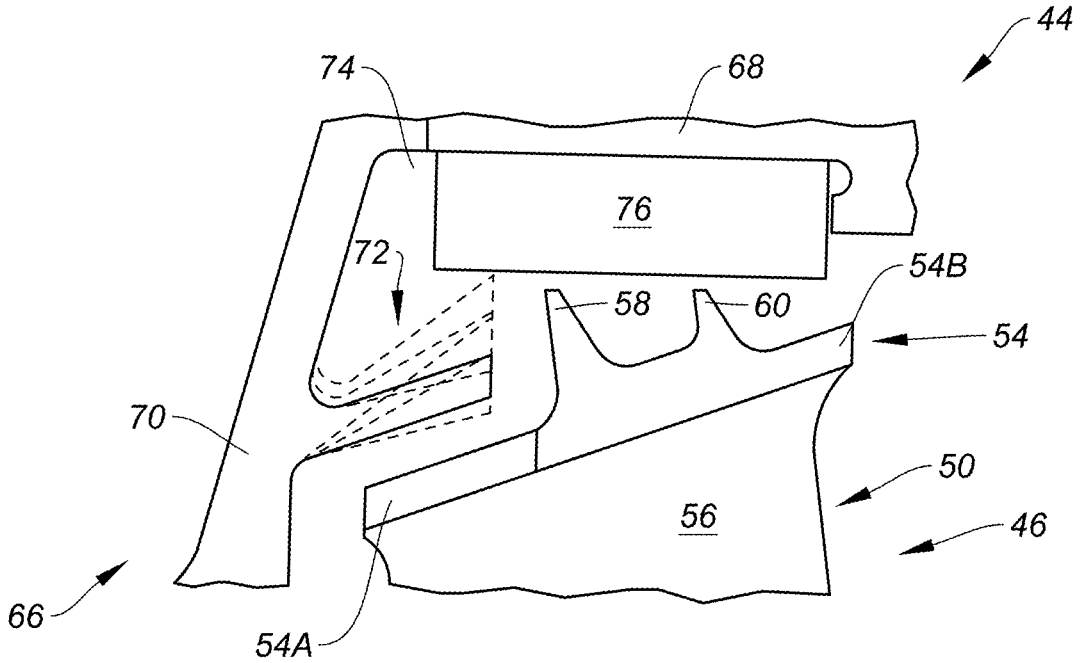
FIG. 5A shows the shrouded turbine assembly embodiment depicted in FIG. 5, including alternative air deflector orientations.
Figure 5B:
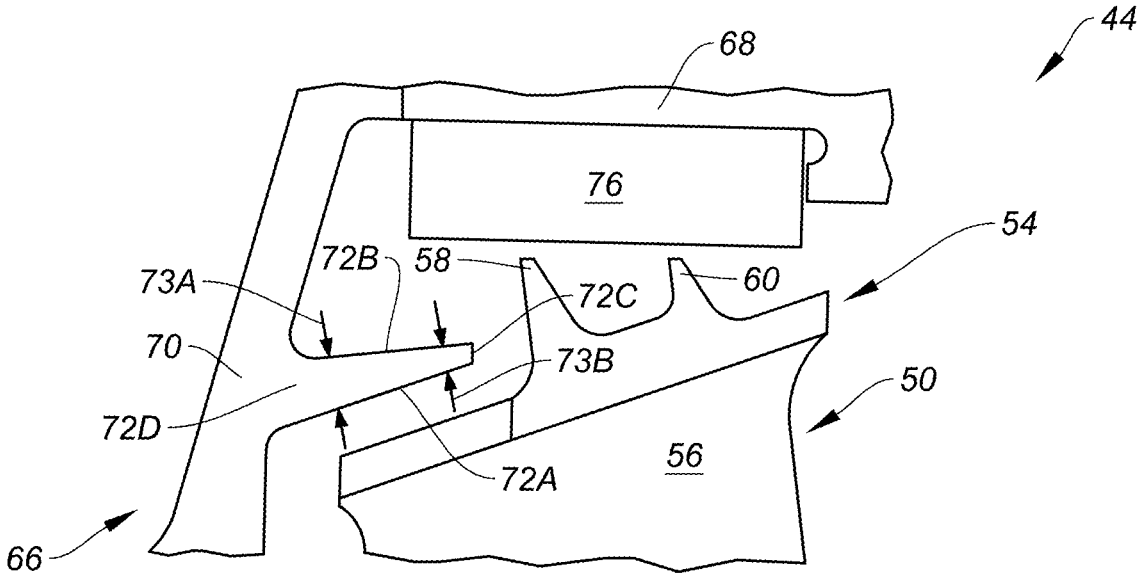
FIG. 5B shows the shrouded turbine assembly embodiment depicted in FIG. 5, including an alternative air deflector configuration.

The air diverter 72 embodiment shown in FIG. 5 may be described as having an inner radial surface 72A, an outer radial surface 72B, a tip surface 72C, a base end 72D, and a thickness 73. The thickness 73 is the distance between the inner and outer radial surfaces 72A, 72B. In the embodiment shown in FIG. 5, the outer radial surface 72B and the tip surface 72C are shown forming a sharp intersection therebetween; e.g., the outer radial surface 72B and the tip surface 72C are oriented at an acute angle relative to one another. The present disclosure does not require a sharp intersection between the outer radial surface 72B and the tip surface 72C. The first and second shroud fins 58, 60 extend outwardly toward the outer rotor blade seal 76. In this embodiment the air diverter 72 is a cantilevered body extending outwardly from the casing segment 70. In the embodiment shown in FIG. 5, at least the leading edge portion 54A of the partial shroud 54 of the rotor blade 50 is disposed at an acute angle beta ("β") relative to the central axis 30 of the rotor assembly 46/gas turbine engine 20. Also in this embodiment, the air diverter 72 extends along an axis that is substantially parallel to the leading edge portion 54A of the partial shroud 54 of the rotor blade 50; i.e., both are disposed at acute angle beta ("β"). In the embodiment shown in FIG. 5, the air diverter 72 forms a radial gap 78 with the leading edge portion 54A of the partial shroud 54 of the rotor blade 50, and forms an axial gap 80 with the first shroud fin 58. FIG. 5A diagrammatically illustrates a plurality of air diverter 72 orientations that may be used as an alternative to the air diverter 72 orientation shown in FIG. 5. As can be seen in FIG. 5A, the alternative air diverter 72 orientations may be used to alter one or both of the axial and radial gaps and are shown to illustrate that the air diverter 72 orientation may vary to suit different applications. As can be seen in both FIGS. 5 and 5A, the air diverter 72 in part defines a sub-cavity within the cavity 74 disposed radially outside of the outer radial surface of the air diverter 72. The air diverter 72 embodiment shown in FIG. 5 has a uniform thickness throughout substantially all of the distance from the base end 72D and the tip surface 72C; i.e., the inner and outer radial surfaces 72A, 72B are parallel one another. The phrase "throughout substantially all of the distance from the base end 72D and the tip surface 72C" is used here to mean that the thickness 73 is uniform except in the region adjacent the base end 72D where fillets may be included. The present disclosure is not limited to this embodiment. For example, in FIG. 5B, the air diverter 72 has a tapered configuration with a decreasing thickness in the direction from the base end 72D to the tip surface 72C; e.g., thickness 73A is greater than thickness 73B. The tapered embodiment shown in FIG. 5B is a non-limiting example of an air diverter 72 configuration that may be used to address stress within the air diverter 72. The present disclosure is not limited to the specific air diverter 72 geometric configurations described herein (e.g., uniform thickness, tapered thickness) and alternative air diverter configurations may be used.

Figure 6:
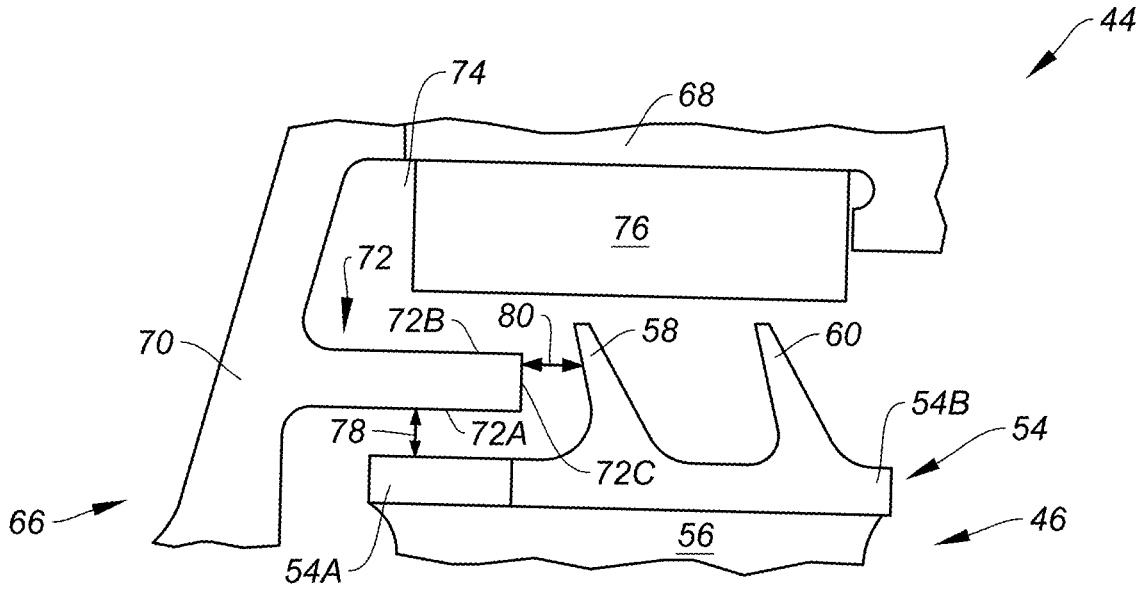
FIG. 6 is a diagrammatic view of a present disclosure shrouded turbine assembly embodiment.

The air diverter 72 embodiment shown in FIG. 6 may be described as having an inner radial surface 72A, an outer radial surface 72B, and a tip surface 72C. In the embodiment shown in FIG. 6, the outer radial surface 72B and the tip surface 72C are shown as being perpendicular to one another. Alternatively, the tip surface 72C may be oriented relative to the outer radial surface 72B to form a sharp intersection as described above and shown in FIG. 5. In the embodiment shown in FIG. 6, the air diverter 72 is a cantilevered body extending outwardly from the casing segment 70 of the outer radial casing structure 66 for the forward vane assembly. The air diverter 72 and at least the leading edge portion 54A of the partial shroud 54 of the rotor blade 50 are disposed parallel to the central axis 30 of the rotor assembly 46/gas turbine engine 20. The first and second shroud fins 58, 60 extend outwardly toward the outer rotor blade seal 76. The air diverter 72 extends around the circumference of the shrouded turbine assembly 44. The air diverter 72 may extend continuously around the circumference of the shrouded turbine assembly 44 or may be collectively formed by circumferential segments. In the embodiment shown in FIG. 6, the air diverter 72 forms a radial gap 78 with the leading edge portion 54A of the partial shroud 54 of the rotor blade 50, and forms an axial gap 80 with the first shroud fin 58. Here again, the air diverter 72 in part defines a sub-cavity within the cavity 74 region disposed radially outside of the outer radial surface of the air diverter 72.

Figure 7:
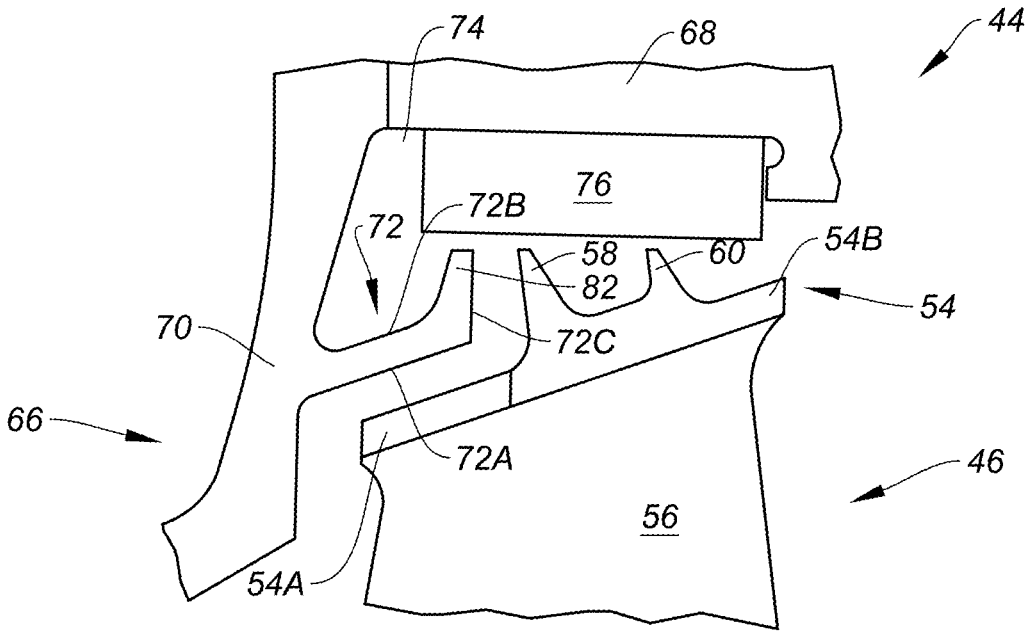
FIG. 7 is a diagrammatic view of a present disclosure shrouded turbine assembly embodiment.

The air diverter 72 embodiment shown in FIG. 7 is similar to the air diverter 72 embodiment shown in FIG. 5; e.g., inner radial surface 72A, outer radial surface 72B, and tip surface 72C, and is cantilevered, extending outwardly from the casing segment 70 at an acute angle beta ("β") relative to the central axis 30 of the rotor assembly 46/gas turbine engine 20. In this embodiment, however, the air diverter 72 includes a tip extension 82 disposed at a distal end of the air diverter 72 that extends outwardly in a direction toward outer rotor blade seal 76, thereby giving the air diverter 72 an "L-like" configuration. The tip extension 82 of the air diverter 72 may alternatively be described as a knife-edge element. Like the air diverter 72 shown in FIG. 5, the air diverter 72 shown in FIG. 7 defines a sub-cavity of the annular cavity 74 disposed radially outside of the outer radial surface 72B of the air diverter 72. The tip extension 82 further defines that sub-cavity, providing a decreased opening into the sub-cavity.

Figure 8:
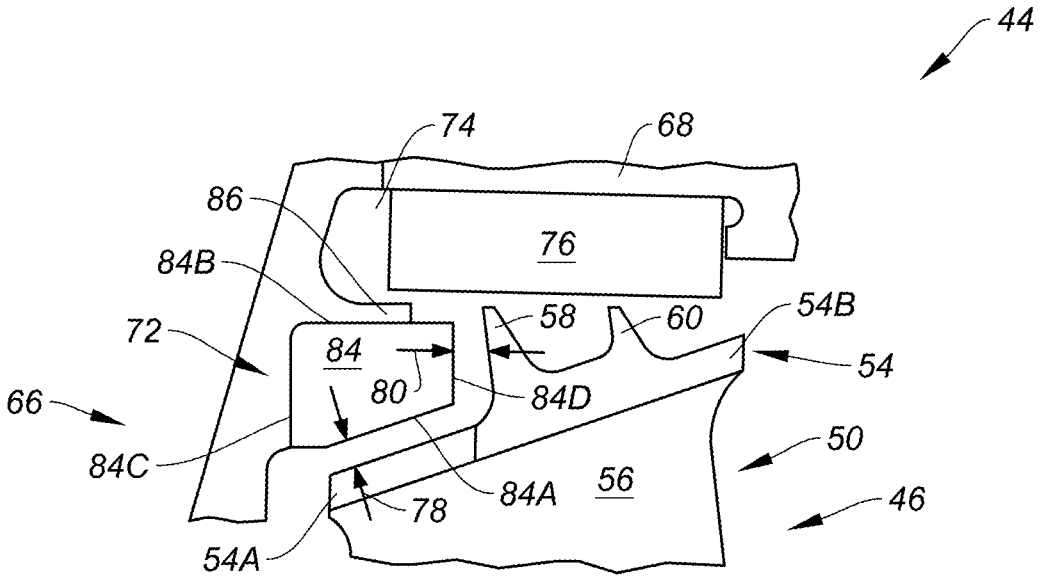
FIG. 8 is a diagrammatic view of a present disclosure shrouded turbine assembly embodiment.

The air diverter 72 embodiment shown in FIG. 8 includes a seal ring 84 and a support flange 86 extending outwardly from the casing segment 70. The seal ring 84 may comprise an abradable material configured as a honeycomb lattice or the like. The seal ring 84 may be described as having an inner radial surface 84A, an outer radial surface 84B, a forward surface 84C, and an aft surface 84D. The support flange 86 is disposed radially outside of the seal ring 84. The support flange 86 and the casing segment 70 are collectively configured to locate and support the seal ring 84. The inner radial surface 84A may be oriented to be parallel with the leading edge portion 54A of the partial shroud 54 of the rotor blade 50 and form a radial gap 78 therebetween. The aft surface 84D may be oriented to be generally parallel with a surface of the first shroud fin 58 and form an axial gap 80 therebetween. The term "generally parallel" is used here to mean that the two surfaces if not parallel are within a small angle deviation from parallel, such as less than fifteen degrees (<15°). The seal ring 84 may be held stationary relative to the casing segment 70 by means including but not limited to a press fit, mechanical fastener, or the like.

In any of the shrouded turbine assembly 44 embodiments described herein, the air deflector 72 may be configured relative to first shroud fin 58 such that the axial gap 80 is substantially equal to the gap between the casing segment 70 and the forwardmost edge of the shroud 54 of the rotor blade 50. In any of the shrouded turbine assembly 44 embodiments described herein, the radial gap 78 may be selected in view of thermal displacement of the rotor blade 50 relative to the air deflector 72 to ensure an appropriate gap exists.

Figure 9:
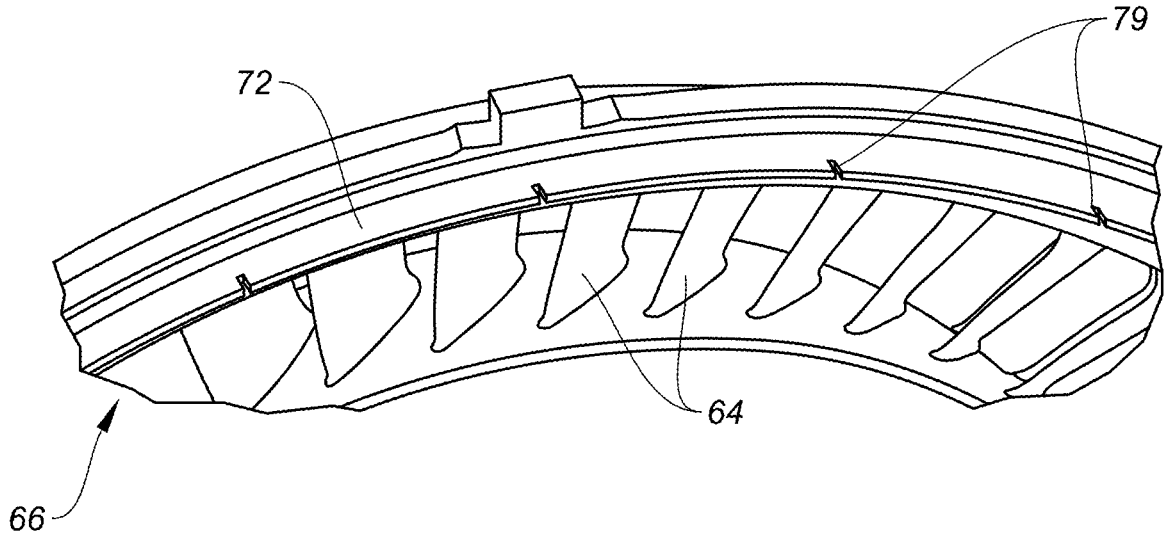
FIG. 9 is a diagrammatic perspective view of a forward vane assembly illustrating an air diverter embodiment that includes relief features.

In some embodiments, the air deflector 72 may include relief features (e.g., slots, scallops, or the like) to mitigate stresses (e.g., hoop stress) within the air deflector 72. FIG. 9 illustrates an example of an air deflector 72 having relief features in the form of slots 79. The present disclosure is not limited to using slots as relief features.

In a prior art fully shrouded rotor blade, some amount of core gas flow is understood to pass through the opening between the forward vane outer radial casing 66 and the leading edge portion 54A of the shroud 54, and pass into the annular cavity 74 forward of the shroud fins 58, 60. The core gas traveling along this path is understood to create flow disturbances within the cavity region 74, and may produce some amount of undesirable circumferential flow leading to lost gas path flow momentum (parasitic work) that negatively affects the engine cycle specific fuel consumption (SFC). At least some of this core gas flow eventually passes between the shroud fins 58, 60 and subsequently reenters the core gas flow path. This core gas flow contributes no work during this passage (i.e., no work transferred to the rotor turbine blades) and therefore negatively affects the engine cycle specific fuel consumption (SFC). During reentry, this core gas is understood to produce flow mixing losses which also negatively affect SFC. A fully shrouded rotor blade is understood to be more efficient aerodynamically (i.e., less losses) than a comparable partially shrouded rotor blade, but the greater aerodynamic efficiency is at the cost of greater stress in the rotor blades. The present disclosure provides a novel and unobvious improvement that can be utilized with fully shrouded rotor assemblies as well as partially shrouded rotor assemblies. The statically mounted air deflector 72 is understood to potentially decrease the flow of core gas passing over the shrouded rotor blades and therefore the losses associated therewith without increasing the amount of stress experienced by the shrouded rotor assembly 46 during operation. Hence, the present disclosure is understood to provide significant performance benefits for both fully shrouded and partially shrouded rotor assemblies. The present disclosure also greatly facilitates assembly of the turbine section 28 by permitting axial assembly of the respective components.

While the principles of the disclosure have been described above in connection with specific apparatuses and methods, it is to be clearly understood that this description is made only by way of example and not as limitation on the scope of the disclosure. Specific details are given in the above description to provide a thorough understanding of the embodiments. However, it is understood that the embodiments may be practiced without these specific details.

It is noted that the embodiments may be described as a process which is depicted as a flowchart, a flow diagram, a block diagram, etc. Although any one of these structures may describe the operations as a sequential process, many of the operations can be performed in parallel or concurrently. In addition, the order of the operations may be rearranged. A process may correspond to a method, a function, a procedure, a subroutine, a subprogram, etc.

The singular forms "a," "an," and "the" refer to one or more than one, unless the context clearly dictates otherwise. For example, the term "comprising a specimen" includes single or plural specimens and is considered equivalent to the phrase "comprising at least one specimen." The term "or" refers to a single element of stated alternative elements or a combination of two or more elements unless the context clearly indicates otherwise. As used herein, "comprises" means "includes." Thus, "comprising A or B," means "including A or B, or A and B," without excluding additional elements.

It is noted that various connections are set forth between elements in the present description and drawings (the contents of which are included in this disclosure by way of reference). It is noted that these connections are general and, unless specified otherwise, may be direct or indirect and that this specification is not intended to be limiting in this respect. Any reference to attached, fixed, connected or the like may include permanent, removable, temporary, partial, full and/or any other possible attachment option.

No element, component, or method step in the present disclosure is intended to be dedicated to the public regardless of whether the element, component, or method step is explicitly recited in the claims. No claim element herein is to be construed under the provisions of 35 U.S.C. 112 (f) unless the element is expressly recited using the phrase "means for." As used herein, the terms "comprise", "comprising", or any other variation thereof, are intended to cover a non-exclusive inclusion, such that a process, method, article, or apparatus that comprises a list of elements does not include only those elements but may include other elements not expressly listed or inherent to such process, method, article, or apparatus.

While various inventive aspects, concepts and features of the disclosures may be described and illustrated herein as embodied in combination in the exemplary embodiments, these various aspects, concepts, and features may be used in many alternative embodiments, either individually or in various combinations and sub-combinations thereof. Unless expressly excluded herein all such combinations and sub-combinations are intended to be within the scope of the present application. Still further, while various alternative embodiments as to the various aspects, concepts, and features of the disclosures—such as alternative materials, structures, configurations, methods, devices, and components, and so on—may be described herein, such descriptions are not intended to be a complete or exhaustive list of available alternative embodiments, whether presently known or later developed. Those skilled in the art may readily adopt one or more of the inventive aspects, concepts, or features into additional embodiments and uses within the scope of the present application even if such embodiments are not expressly disclosed herein. For example, in the exemplary embodiments described above within the Detailed Description portion of the present specification, elements may be described as individual units and shown as independent of one another to facilitate the description. In alternative embodiments, such elements may be configured as combined elements. It is further noted that various method or process steps for embodiments of the present disclosure are described herein. The description may present method and/or process steps as a particular sequence. However, to the extent that the method or process does not rely on the particular order of steps set forth herein, the method or process should not be limited to the particular sequence of steps described. As one of ordinary skill in the art would appreciate, other sequences of steps may be possible.

The invention claimed is:

1. A shrouded turbine assembly for a gas turbine engine, comprising:

a rotor assembly having a plurality of rotor blades circumferentially distributed around a disk, each rotor blade of the plurality of rotor blades extending from the disk to a shrouded end, each rotor blade having a shroud disposed at the shrouded end, and the shroud including at least one shroud fin, a leading edge portion extending axially forward from the at least one shroud fin, and a trailing edge portion extending axially aft from the at least one shroud fin; and a forward vane assembly disposed forward of the rotor assembly, the forward vane assembly having a plurality of first vanes disposed in an annular configuration, with each first vane of the plurality of first vanes extending between a first vane inner radial platform to a first vane outer radial platform, the forward vane assembly including an outer radial casing that includes a casing segment and an air diverter, wherein the air diverter extends axially and is disposed radially outside of the shroud of each rotor blade of the plurality of rotor blades;

wherein the air diverter has an inner radial surface, an outer radial surface, and a tip surface that extends between the inner radial surface and the outer radial surface; and wherein the inner radial surface is substantially parallel with a substantially planar surface of the leading edge portion of the shroud, the substantially planar surface extending immediately axially forward from the at least one shroud fin.

2. The shrouded turbine assembly of claim 1, wherein the air diverter is disposed radially outside of the leading edge portion of the shroud of each rotor blade of the plurality of rotor blades.

3. The shrouded turbine assembly of claim 2, wherein the outer radial surface and the tip surface intersect with one another at an intersection and are configured to form an acute angle between the outer radial surface and the tip surface at the intersection.

4. The shrouded turbine assembly of claim 2, wherein the inner radial surface is radially spaced apart from the leading edge portion of the shroud of each rotor blade of the plurality of rotor blades by a radial gap.

5. The shrouded turbine assembly of claim 4, wherein the tip surface is axially spaced apart from the shroud fin of each rotor blade of the plurality of rotor blades by an axial gap.

6. The shrouded turbine assembly of claim 5, wherein the rotor assembly is configured to rotate about a central axis; and wherein the air diverter and the leading edge portion of the shroud of each rotor blade of the plurality of rotor blades are both disposed at an acute angle relative to the central axis of the rotor assembly.

7. The shrouded turbine assembly of claim 5, wherein the air diverter further includes a tip extension extending outwardly from the outer radial surface of the air diverter and disposed adjacent the tip surface.

8. The shrouded turbine assembly of claim 5, further comprising an aft vane assembly disposed aft of the rotor assembly, the aft vane assembly having a plurality of second vanes disposed in an annular configuration, with each second vane of the plurality of second vanes extending from a second vane inner radial platform to a second vane outer radial platform, the aft vane assembly including an second outer radial casing that extends forward of the plurality of second vanes and is disposed radially outside of the shroud of each rotor blade of the plurality of rotor blades, and is engaged with the outer radial casing of the forward vane assembly to form an annular cavity disposed radially outside of the rotor assembly.

9. The shrouded turbine assembly of claim 8, further comprising an outer rotor blade seal disposed in the annular cavity.

10. The shrouded turbine assembly of claim 1, wherein the shroud of each rotor blade is a partial shroud.

11. The shrouded turbine assembly of claim 1, wherein the shroud of each rotor blade is a full shroud.

12. The shrouded turbine assembly of claim 1, wherein the air diverter has a base end, and a thickness between the inner radial surface and the outer radial surface, wherein the thickness is uniform for substantially all of the distance between the base end and the tip surface.

13. The shrouded turbine assembly of claim 1, wherein the air diverter has a base end and a thickness between the inner radial surface and the outer radial surface, wherein the thickness is non-uniform between the base end and the tip surface.

14. A gas turbine engine, comprising:

a rotor assembly having a plurality of rotor blades circumferentially distributed around a disk, each rotor blade of the plurality of rotor blades extending from the disk to a shrouded end, each rotor blade having a shroud disposed at the shrouded end, and the shroud including at least one shroud fin, a leading edge portion extending axially forward from the at least one shroud fin, and a trailing edge portion extending axially aft from the at least one shroud fin;

a forward vane assembly disposed forward of the rotor assembly, the forward vane assembly having a plurality of first vanes disposed in an annular configuration, with each first vane of the plurality of first vanes extending between a first vane inner radial platform to a first vane outer radial platform, the forward vane assembly including an outer radial casing that includes a casing segment and an air diverter, wherein the air diverter extends axially and is disposed radially outside of the shroud of each rotor blade of the plurality of rotor blades; and an aft vane assembly disposed aft of the rotor assembly, the aft vane assembly having a plurality of second vanes disposed in an annular configuration, with each second vane of the plurality of second vanes extending from a second vane inner radial platform to a second vane outer radial platform, the aft vane assembly including an second outer radial casing that extends forward of the plurality of second vanes and is disposed radially outside of the shroud of each rotor blade of the plurality of rotor blades, and is engaged with the outer radial casing of the forward vane assembly to form an annular cavity disposed radially outside of the rotor assembly;

wherein the air diverter has an inner radial surface, an outer radial surface, and a tip surface that extends between the inner radial surface and the outer radial surface; and wherein the inner radial surface is substantially parallel with a substantially planar surface of the leading edge portion of the shroud, the substantially planar surface extending immediately axially forward from the at least one shroud fin.

* * * * *